US011246434B2

(12) United States Patent
Siegenthaler

(10) Patent No.: US 11,246,434 B2
(45) Date of Patent: Feb. 15, 2022

(54) CLOSING DEVICE FOR A BEVERAGE CONTAINER

(71) Applicant: ESBIT Compagnie GmbH, Hamburg (DE)

(72) Inventor: Simon Siegenthaler, Pfeffikon LU (CH)

(73) Assignee: ESBIT Compagnie GmbH, Hamburg (DE)

( * ) Notice: Subject to any disclaimer, the term of this patent is extended or adjusted under 35 U.S.C. 154(b) by 0 days.

(21) Appl. No.: 17/048,468

(22) PCT Filed: Apr. 10, 2019

(86) PCT No.: PCT/EP2019/059019

§ 371 (c)(1),
(2) Date: Oct. 16, 2020

(87) PCT Pub. No.: WO2019/201691

PCT Pub. Date: Oct. 24, 2019

(65) Prior Publication Data

US 2021/0177173 A1 Jun. 17, 2021

(30) Foreign Application Priority Data

Apr. 16, 2018 (DE) ..... 20 2018 102 047.1 U

(51) Int. Cl.
*A47G 19/22* (2006.01)
*B65D 47/26* (2006.01)

(52) U.S. Cl.
CPC ..... *A47G 19/2272* (2013.01); *B65D 47/265* (2013.01); *B65D 2251/0025* (2013.01); *B65D 2543/00046* (2013.01)

(58) Field of Classification Search
CPC ..... A47G 19/2272; B65D 47/265; B65D 2251/0025; B65D 2543/00046
(Continued)

(56) References Cited

U.S. PATENT DOCUMENTS 3,776,433 A * 12/1973 De Treitas ..... A47J 41/0027 222/519
4,121,730 A * 10/1978 Dammer ..... A47J 41/0005 215/310

(Continued)

FOREIGN PATENT DOCUMENTS

DE 4305601 C2 7/1998
DE 60219045 T2 12/2007

(Continued)

OTHER PUBLICATIONS

PCT International Search Report for International application No. PCT/EP2019/059019 filed Apr. 10, 2019; dated Jul. 19, 2019; 2pgs.

(Continued)

*Primary Examiner* — James N Smalley
(74) *Attorney, Agent, or Firm* — Alix, Yale & Ristas, LLP

(57) ABSTRACT

The invention relates to a closing device for a beverage container, comprising a closing body and a closing lid, said closing lid being mounted such that it can rotate, relative to the closing body, between a flow state and a sealed state. A liquid channel of the closing body is released in the flow state and blocked in the sealed state. A guide device is arranged between the closing lid and the closing body. The guide device has two preferred positions, which define the sealed state and the flow state. The rotatable mount between the closing lid and the closing body is in the form of a threaded mount.

16 Claims, 6 Drawing Sheets

(58) Field of Classification Search
USPC ..... 220/253, 254.8
See application file for complete search history.

(56) References Cited

U.S. PATENT DOCUMENTS

| | | | | |
|---|---|---|---|---|
| 4,190,173 | A | 2/1980 | Mason et al. | |
| 4,658,973 | A * | 4/1987 | Zimmermann | A47J 41/0022 215/12.1 |
| 5,294,014 | A | 3/1994 | Wyatt et al. | |
| 5,477,979 | A * | 12/1995 | Goessling | A47G 19/2272 220/259.3 |
| 5,680,951 | A * | 10/1997 | Feltman, III | A47G 19/2272 220/253 |
| 6,736,295 | B2 * | 5/2004 | Lin | A47J 41/0016 215/13.1 |
| 7,819,280 | B2 * | 10/2010 | Perra | B65D 51/1677 220/821 |
| 9,215,942 | B2 * | 12/2015 | Bodum | A47G 19/2272 |
| 9,540,151 | B2 * | 1/2017 | Niggel | B65D 47/265 |
| 9,745,110 | B2 * | 8/2017 | Boyer | A47J 41/0027 |
| 2003/0024929 | A1 | 2/2003 | Smith et al. | |
| 2010/0133227 | A1 * | 6/2010 | Ver Hage | A01K 7/06 215/344 |
| 2011/0174830 | A1 | 7/2011 | Liao | |
| 2011/0198352 | A1 * | 8/2011 | Lown | B65D 47/32 220/254.8 |
| 2013/0213966 | A1 | 8/2013 | Steininger et al. | |
| 2018/0050849 | A1 | 2/2018 | Egan et al. | |
| 2019/0112112 | A1 * | 4/2019 | Choltco-Devlin | B65D 43/0225 |

FOREIGN PATENT DOCUMENTS

| | | | |
|---|---|---|---|
| EP | 0196198 | A1 | 10/1986 |
| JP | 2004123172 | A | 4/2004 |
| JP | 2005246043 | A | 9/2005 |
| JP | 2014028634 | A | 2/2014 |
| KR | 200317877 | Y1 | 6/2003 |

OTHER PUBLICATIONS

PCT International Written Opinion of the International Searching Authority for International file No. PCT/EP2019/059019 filed Apr. 10, 2019; dated Jul. 19, 2019, 3 pgs.

German Search Report for application No. 202018 102 047.1; dated Aug. 24, 2018; 5 pgs.

* cited by examiner

CLOSING DEVICE FOR A BEVERAGE CONTAINER

BACKGROUND

The invention relates to a closing device for a beverage container. The closing device comprises a closing body and a closing lid, wherein the closing lid is mounted so as to be rotatable in relation to the closing body between a flow state and a sealing state. A liquid passage of the closing body is free in the flow state and is closed in the sealing state.

Closing devices for beverage containers are frequently complex constructions with a multiplicity of functional components and/or are based on complex mechanisms, making intuitive handling difficult.

SUMMARY OF THE INVENTION

The invention is based on the object of presenting a closing device for a beverage container, the closing device being simple to operate and easy to clean. The object is achieved by the features of claim 1. Advantageous embodiments are specified in the dependent claims.

The closing device according to the invention has a guide device between the closing lid and the closing body, wherein the guide device comprises a first preferred position and a second preferred position with which the sealing state and the flow state are defined. The rotatable mounting between the closing lid and the closing body is in the form of a threaded mounting.

Closeable beverage containers have two essential use states, the container in one state being closed in a sealing manner and, in the other state, liquid being able to flow out of the container. Said two states can be identified by the user of the closing device according to the invention on the basis of two preferred positions for the closing lid as the latter is being rotated.

Some terms will be explained first. The closing body refers to the closing device component which fits to a lower part of a beverage container and with which an opening of the lower part can be sealed. A liquid passage and/or an air duct can be formed in the closing body.

The closing lid refers to a closing device component which interacts with the closing body, wherein the closing lid can be mounted rotatably in relation to the closing body. In a sealing state, the closing lid can close one or more passages of the closing body in a sealing manner and, in a flow state, can expose one or more passages in such a manner that liquid can flow out of the beverage container. The beverage container can be positioned at the mouth such that the user can drink directly from the beverage container. It is also possible to decant the liquid from the beverage container into a different vessel.

The sealing state and the flow state can each correspond to an angular position or to an angular range, which is centered about said angular position, of the rotation between the closing lid and the closing body. The angular position to be set for the sealing state can be less than half a revolution, for example a quarter revolution, from the angular position to be set for the flow state.

A guide device refers to a mechanism which distinguishes one or more angular positions between the closing lid and the closing body and makes same identifiable for the user. Such an angular position which is made identifiable is referred to as a preferred position. A first and a second preferred position can each mark an angular position to be set for the sealing state or for the flow state.

A preferred position can be identifiable by tactile means; for example, the rotational resistance on leaving the preferred position can be greater than the rotational resistance on reaching the preferred position.

The guide device can be in the form of a sliding guide in which a guide element of the closing lid is in engagement with a guide element of the closing body on the actuation path between the sealing state and the flow state. The guide device can set a predetermined friction force against a relative movement between the closing lid and the closing body, relative to which friction force the preferred position is defined. The friction force can be constant over the actuation path between the sealing state and the flow state. This can be true of both directions of movement of the actuation path. The preferred positions do not belong to the actuation path in this sense.

The guide device can be configured in such a manner that the rotation resistance becomes smaller during the transition from the actuation path and to the first preferred position and/or to the second preferred position. On the side facing away from the actuation path, the first preferred position and/or the second preferred position can be delimited by a stop of the guide device. The stops can be configured as guide stops or as end stops. An end stop prevents a further relative movement between the closing lid and the closing body even when an increased force is applied. A guide stop can be overcome by increased effort. A guide stop can act on both sides, and therefore it can be overcome by increased effort both when leaving the preferred position in the direction opposed to the actuation path and when approaching the preferred position from the direction opposed to the actuation path. If a preferred position is overcome by overcoming a guide stop, a movement path can be opened up, along which the closing lid can be separated from the closing body. In one embodiment, the preferred position corresponding to the flow state is limited by a guide stop and the preferred position corresponding to the sealing state is limited by an end stop.

A guide stop can be in the form, for example, of a convex curvature of lower height and/or with gentle flanks; an end stop can be in the form, for example, of a convex curvature with a greater height and/or with edges.

The guide device can be configured in such a manner that an increased resistance has to be overcome during the transition from a preferred position to the actuation path. The force required for overcoming the increased resistance can be smaller than the force required for overcoming a guide stop.

A first guide element of the guide device can be in the form of a guide surface which is concentric to the axis of rotation of the closing lid. A section of the guide surface can define the actuation path. The first preferred position and/or the second preferred position can be configured as sections which are set back in relation to the guide surface. A stop can be in the form of a section which projects relative to the guide surface. In one embodiment, the guide surface is arranged on the closing body.

The guide surface can be a circumferential surface with respect to the axis of rotation of the closing lid. The guide surface can extend in sections along two circles which are concentric to the axis of rotation. The radii of the two circles can be identical or can differ from one another within a section; the radii of the circles can assume different values in different sections.

A preferred position can be defined as a set-back section of the guide surface. A set-back section can be a concave curvature on a side of the guide surface that faces the second guide element, wherein the cross section of the curvature can be continuous, i.e. can have gentle flanks, and/or discontinuous, i.e. can have an angular profile. In a preferred embodiment, both the first and the second preferred position are defined as set-back sections of the guide surface.

The second guide element can be in the form of a guide body, wherein the guide body can interact with the guide surface. The interaction can take place via a sliding surface of the guide body, wherein the sliding surface can be in contact with the guide surface entirely or via subsections. The sliding surface can be in contact via a first subsection of the sliding surface with a guide surface which is flat or is curved concentrically to the axis of rotation. A second subsection of the sliding surface can continuously adjoin the first subsection along the rotation path, in the direction of rotation and/or counter to the direction of rotation, wherein the distance between the sliding surface and the flat or concentrically curved guide surface in the second subsection can increase continuously as the distance from the first subsection increases along the rotation path. A cross section through the sliding surface along the rotation path can have, for example, a V shape or a Y shape. The convex curvature of a guide stop can enter into contact with the second subsection of the sliding surface of the guide body, wherein a further rotation in the direction of the guide stop can displace the area of contact from the second subsection into the first subsection.

The rotatable mounting between the closing lid and the closing body is in the form of a threaded mounting. The outer thread can be formed on the closing lid or on the closing body. The thread can be a right-handed thread or a left-handed thread; in a preferred embodiment, the thread is a right-handed thread. Rotation from the preferred position of the sealing state into the preferred position of the flow state can mean unscrewing or screwing in the closing lid in relation to the closing body; in a preferred embodiment, the rotation from the sealing state into the flow state means unscrewing.

The thread pitch can be dimensioned in such a manner that the guide device is disengaged axially with an angle of rotation of not more than 360°. For example, during screwing in, the guide body can pass an end stop in an axially offset manner and, after a complete revolution, can butt against the end stop.

A sealing element of the closing lid can rest in a sealing manner on one or more openings in the closing body in the sealing state and can be spaced apart axially from said openings in the flow state. The axial distance can be realized by the coupling of rotational movement and axial movement in a threaded mounting or in another way. The sealing element can be composed, for example, of silicone or rubber. It is of advantage if the closing lid can be produced with the sealing element in a two-component injection molding process. This is possible, for example, if a thermoplastic elastomer (TPE) is used for the sealing element. The closing body can also be an injection molded part. The closing device overall can accordingly be composed of two injection molded parts.

The openings in the closing body can belong to an air passage and to a liquid passage, wherein the air passage can serve for equalizing the pressure when pouring liquid out of the beverage container through the liquid passage. Alternatively or additionally, the sealing element of the closing body can be spaced apart from one or more openings in the closing body in directions perpendicular to the axis of rotation in the flow state. In a preferred embodiment, the sealing element is spaced apart axially from the liquid passage and the air passage in the flow state and additionally from the liquid passage along the rotation path.

The closing lid can be completely separable from the closing body. After the separation, the closing device can consist of two parts. The separating can facilitate, for example, cleaning of the closing device. The separating operation can be undertaken, for example, by pulling on the closing lid, preferably by rotating the closing lid out of the actuation path.

The liquid passage and/or the air passage can open into an end surface on the upper side of the closing body; the upper side of the closing body here refers to the side facing away from the beverage container. The end surface can be curved and/or can have an oblique orientation; in a preferred embodiment, the end surface is flat and runs perpendicular to the axis of rotation between closing lid and closing body. The closing lid can have a sealing element fitting to the end surface, the sealing element in the sealing state sealing the passage openings in the end surface and permitting rotation of the closing lid in relation to the closing body.

The end surface can take up any desired section of the upper side of the closing body. In a preferred embodiment, the end surface is arranged radially outside the guide device. An advantage of the radial arrangement resides in ensuring a sufficient area for the passage openings in the axial region on the far side of the mounting of the closing lid; in addition, a radially positioned opening along a rotation path can be covered and exposed again, for example, by a sealing element.

The guide element of the closing body can be formed at an axial height of the end surface or directly on the end surface. Alternatively, the guide element of the closing body is offset in the axial direction in relation to the end surface. In a preferred embodiment, the guide element is set back in the axial direction in relation to the end surface, which amounts to a displacement in the direction of the lower side of the closing body.

The closing body and the closing lid can be composed, for example, of plastic. Surfaces which will be regularly wetted by liquid during use of the closing device with a beverage container can be polished smooth; affected surfaces can be, for example, the lower side of the closing body and the inner sides of the passages.

The closing device according to the invention can be designed to be connected to a lower part of a beverage container. The closing device can comprise a sealing flange with which a liquid-tight closure between the closing device and the lower part of the beverage container can be produced. The lower part can be designed to receive a liquid. For example, the lower part can have the form of a cup, the opening of which faces upward. The closing device can comprise a threaded component such that the closing device can be connected to the lower part via a threaded connection. The invention also relates to a beverage container comprising such a lower part and such a closing device.

The beverage container can be a drinking vessel in particular in the form of a coffee cup. If the closing lid is in the flow state, the cutout of the closing lid is aligned with the opening of the liquid passage such that drinking from the liquid passage can be undertaken. At the same time, air enters the interior of the beverage container through the air passage such that a negative pressure is avoided in the beverage container. The wall extending upward from the closing body serves as a spout via which the beverage container can be positioned at the mouth. In the sealing state, the closing lid seals the liquid passage and the air passage.

The beverage container is sealed overall such that liquid does not emerge even if the beverage container falls over.

BRIEF DESCRIPTION OF THE DRAWINGS

The invention will be described by way of example below using an advantageous embodiment with reference to the attached drawings, in which.

DETAILED DESCRIPTION

Figure 1:
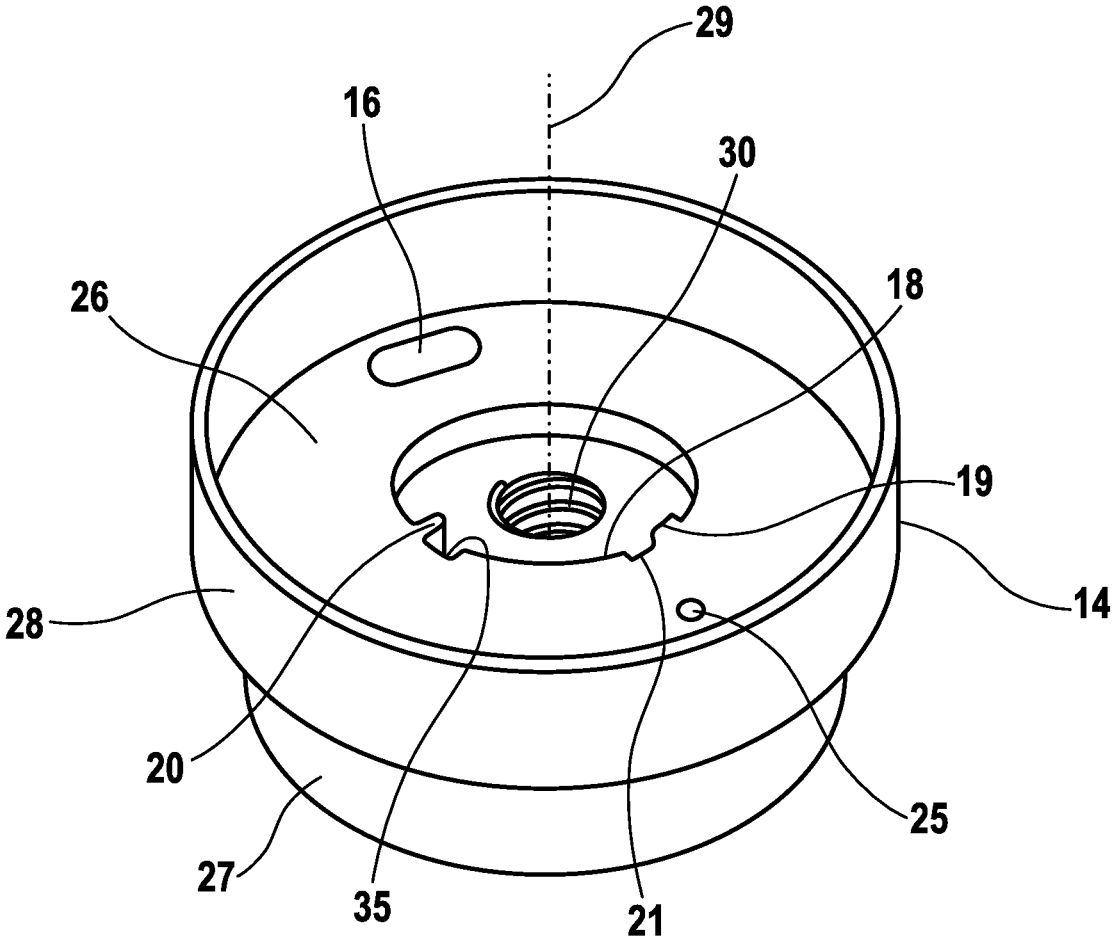
FIG. 1 shows a closing body according to the invention in a perspective view from above.

A closing body 14 shown in FIG. 1 can be connected at its lower side via a sealing flange 27 to a lower part (not shown) of a beverage container. The outer wall 28 of the closing body can end flush with the outer wall of the beverage container. In the center of the closing body 14 there is an internal thread 30 which fits to an external thread 31 on the lower side of a closing lid 15 (FIG. 2).

The upper side of the closing body 14 has a flat end surface 26, wherein the end surface 26 is delimited outward by the outer wall 28 and inward by a central depression. The end surface 26 runs perpendicular to an axis of rotation 29 of the mounting between closing body 14 and closing lid 15 (FIG. 2) and has two openings which correspond to the mouths of a liquid passage 16 and of an air passage 25.

A guide surface 18 which runs perpendicular to the end surface 26 and which is concentric to the axis of rotation 29 is formed in the central depression. A convex curvature of the guide surface 18 with a low height and with gentle flanks defines a guide stop 19. A convex curvature of the guide surface 18 with a greater height and with an angular profile defines an end stop 20. Two concave curvatures define a first preferred position 21 and a second preferred position 35 of the guide surface 18 in the form of set-back sections. An actuation path of the guide device extends between the first preferred position 21 and the second preferred position 35.

Figure 2:
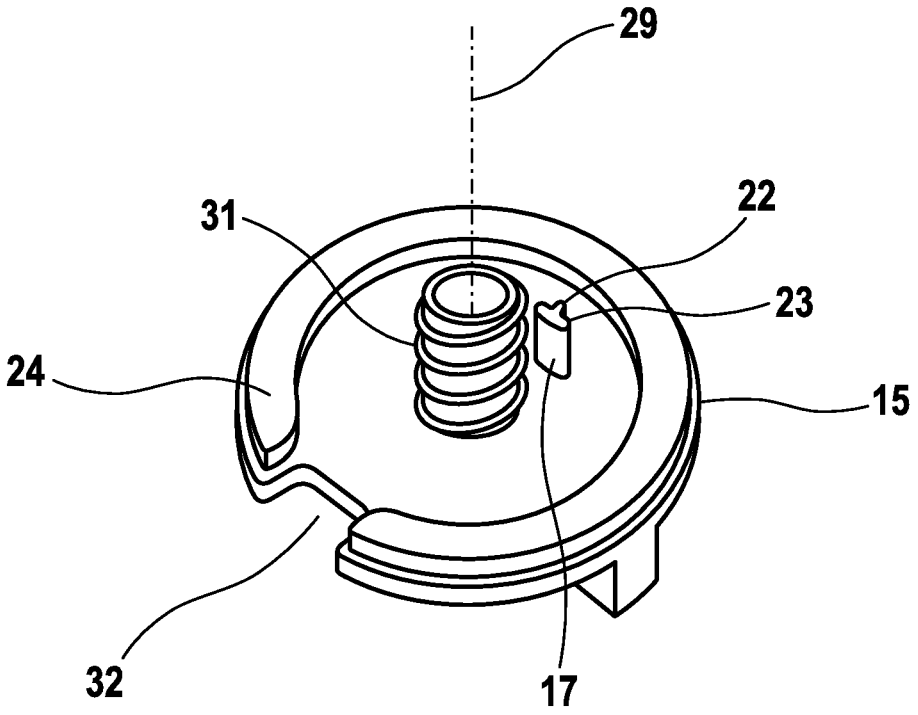
FIG. 2 shows a closing body according to the invention in a perspective view from below.

FIG. 2 shows a closing lid 15 which can be connected to the closing body 14 via a threaded mounting 30, 31. In the flow state, a cutout 32 of the closing lid 15 lies above the liquid passage 16 of the closing body 14. The guide body 17 is then in contact with a set-back section 21 of the guide surface 18 via the first section 22 of the sliding surface and can be simultaneously in contact with the guide stop 19 via a second subsection 23; rotation of the closing lid 15 in the direction of the guide stop 19 brings the subsection 22 of the sliding surface into contact with the guide stop 19 and braces the guide body radially in the direction of the axis of rotation 29, causing locally increased rotation resistance.

During the transition from the first preferred position 21 or the second preferred position 35 to the actuation path, slightly increased rotation resistance has to be overcome. The slightly increased rotation resistance is smaller than the rotation resistance which has to be overcome when overcoming the guide stop 19. The distance of the guide surface 18 from the axis of rotation 29 can be dimensioned outside the actuation path in such a manner that the bracing of the guide element 17 and the associated rotation resistance are smaller than within the actuation path.

Figure 3:
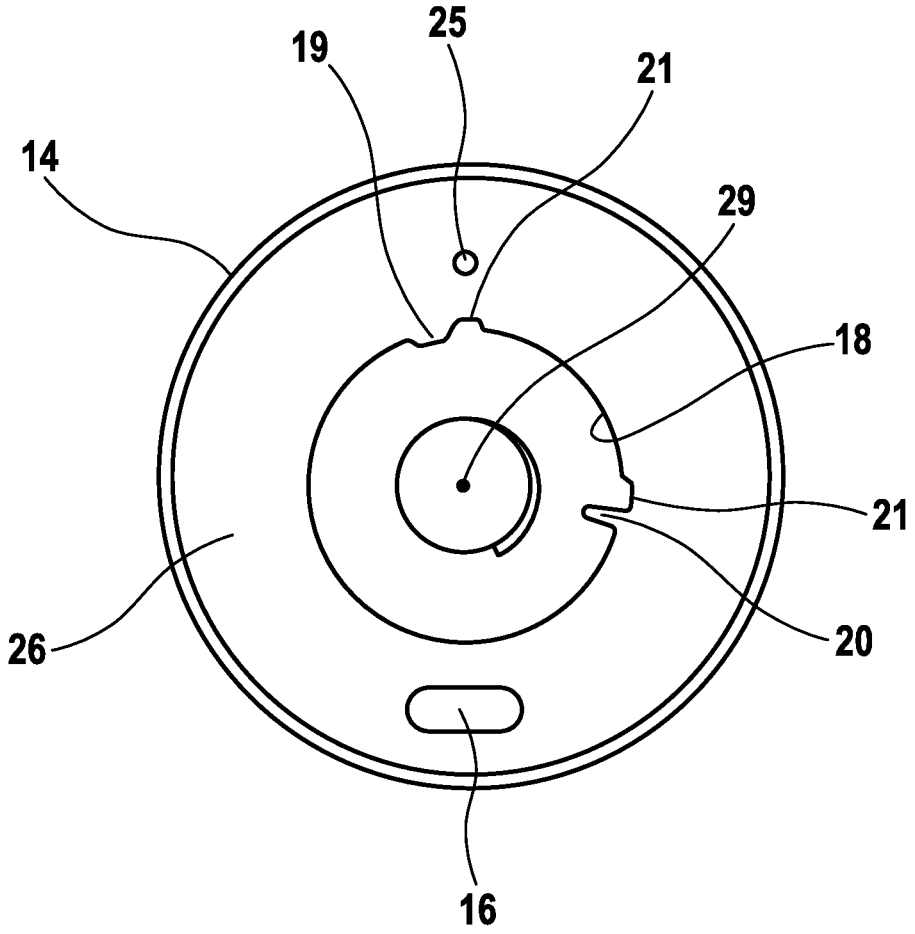
FIG. 3 shows the closing body from FIG. 1 in a view from above.

FIG. 3 shows a top view of the upper side of the closing body 14. The closing device can be brought from the sealing state into the flow state by a quarter rotation of the closing lid 15 counterclockwise relative to the closing body 14. The cutout 32 of the closing lid 15 then lies above the end surface 26 in the left half of the figure; the sealing element 24 lies above the mouths of the liquid passage 16 and of the air passage 25; the guide body 17 of the closing lid 15 is in contact with a set-back section 21 of the guide surface 18 via the first subsection 22 of the sliding surface and can butt laterally against the end stop 20.

Figure 4:
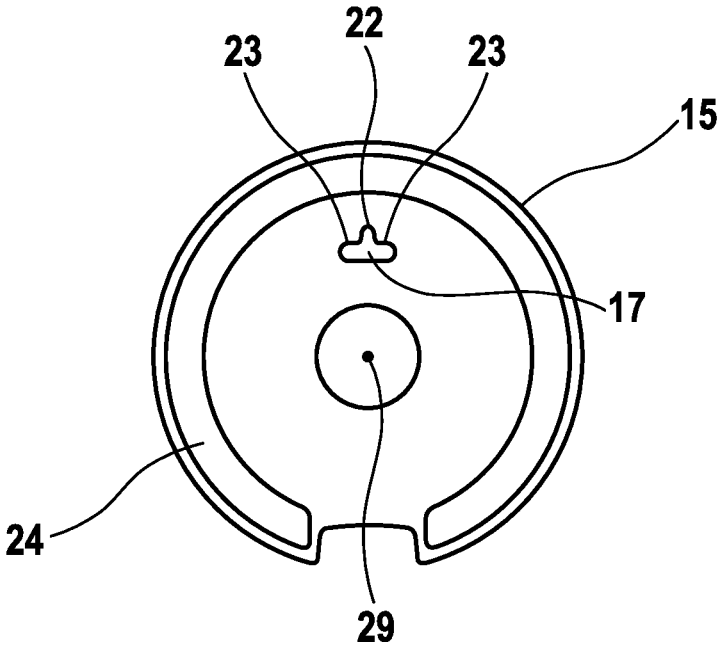
FIG. 4 shows the closing lid from FIG. 2 in a view from below.

The top view of the lower side of the closing lid 15 in FIG. 4 clarifies the position of the subsections 22, 23 of the sliding surface on the guide body 17. The sliding surface lies on that side of the guide body 17 which faces away from the axis of rotation 29 and is similar in profile to an upside down Y. The profile spans the sliding surface with a perpendicular to the plane of the drawing.

Figure 5:
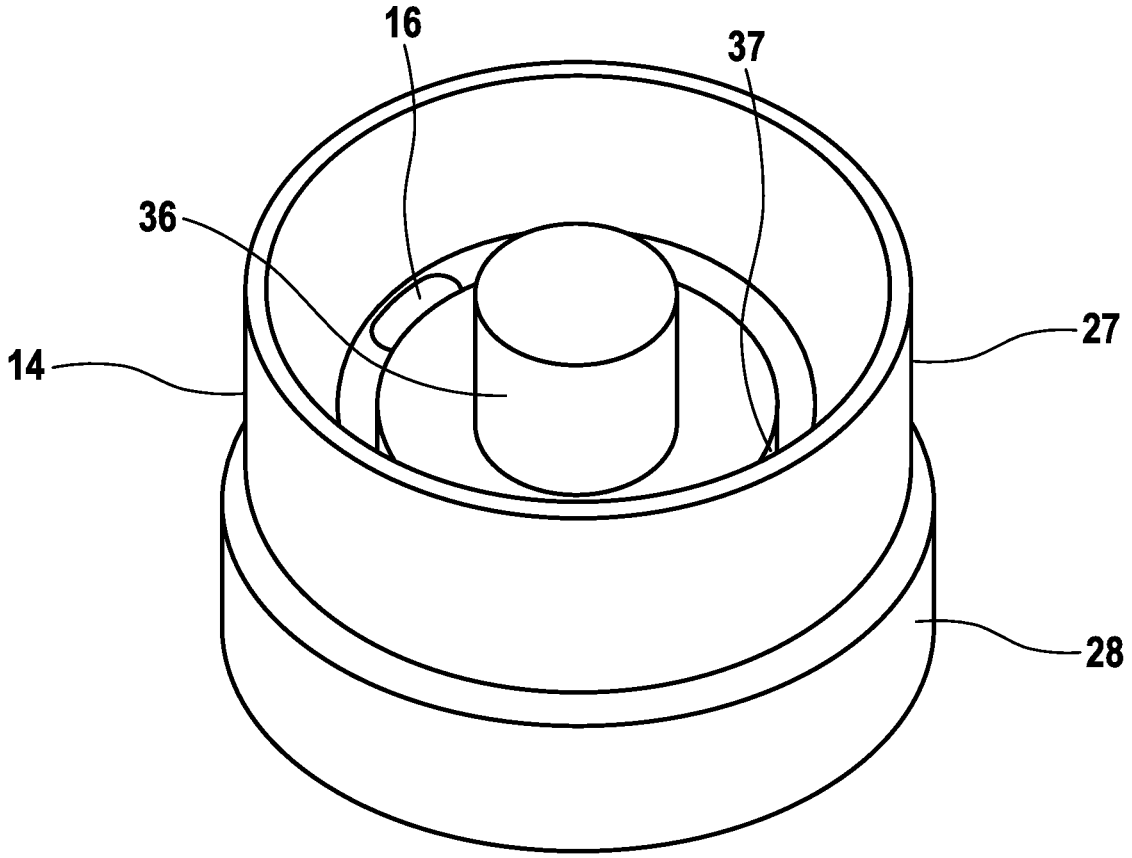
FIG. 5 shows the closing body from FIG. 1 in a perspective illustration from below.

The lower side of the closing body 14 that faces the beverage container is shown in FIG. 5. The closing body 14 is delimited by the sealing flange 27 and the outer wall 28; the rear mouth of the liquid passage 16 and the rear side 37 of the guide surface 18 and the socket 36 of the internal thread 30 can be seen in the interior. The inner surfaces to the lower side of the closing body 14 are regularly wetted with liquid during use of the closing body 14 on a beverage container. In order to reduce the accumulation of impurities and discolorations, the inner surfaces can be polished smooth.

Figure 6:
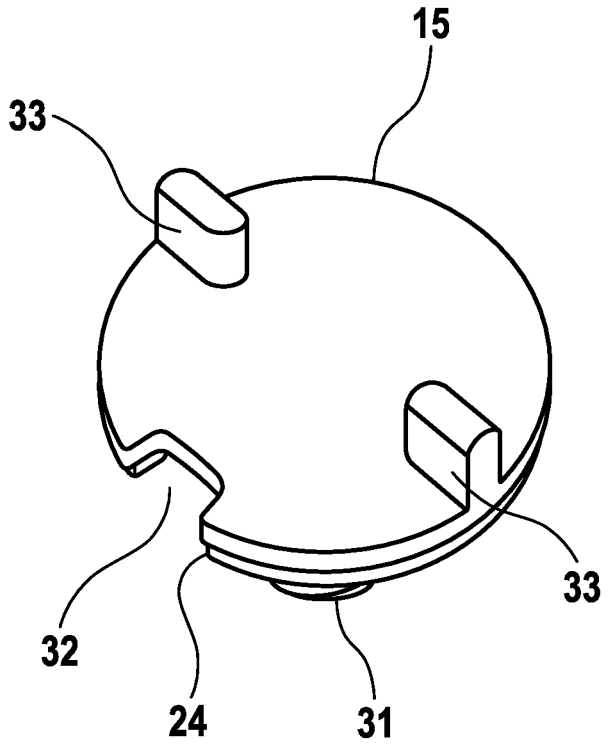
FIG. 6 shows the closing lid from FIG. 2 in a perspective illustration from above.

In the exemplary embodiment shown in FIG. 6, the upper side of the closing lid 15 is provided with grips 33 in order to facilitate the rotation in relation to the closing body 14.

The invention claimed is:

1. A closing device for a beverage container, having a closing body and a closing lid, wherein the closing lid is mounted so as to be rotatable in relation to the closing body between a flow state and a sealing state, wherein a liquid passage through the closing body is open in the flow state and is closed in the sealing state, having a guide between the closing lid and the closing body in the form of a sliding guide with a first guide element on the closing lid and a second guide element on the closing body, wherein the guide comprises two preferred positions with which the sealing state and the flow state are defined, said first guide element sliding along the second guide element on an actuation path between the sealing state and the flow state, wherein the rotatable mounting between the closing lid and the closing body is in the form of a threaded mounting, wherein the thread pitch is dimensioned in such a manner that the guide is disengaged axially by rotation of the closing lid relative to the closing body of not more than 360°.

2. The closing device of claim 1, wherein the reaching of a preferred position or the leaving of a preferred position can be identified by tactile means.

3. The closing device of claim 1, wherein the first preferred position is adjacent to a guide stop which can be overcome, and the second preferred position is adjacent to an end stop.

4. The closing device of claim 1, wherein said second first guide element is in the form of a guide surface, wherein the guide surface is a circumferential surface and is bounded in one or more angular sections by two circles which are concentric to an axis of rotation of the closing lid.

5. The closing device of claim 4, wherein the first preferred position or the second preferred position are defined by a radially outwardly set-back section of the guide surface.

6. The closing device of claim 4, wherein the first guide element comprises a guide body interacting with the guide surface.

7. The closing device of claim 6, wherein the guide body comprises a sliding surface which can be in contact with the guide surface, which sliding surface is flat or is curved concentrically to an axis of rotation of the closing lid, via a first subsection of the sliding surface, wherein the distance between the sliding surface and the guide surface is increased continuously in the direction of rotation in a second subsection of the sliding surface, and wherein the sliding surface can be in contact with a guide stop via the second subsection.

8. The closing device of claim 1, wherein the closing lid is completely separable from the closing body.

9. The closing device claim 1, wherein the liquid passage or an air passage through the closing body open into an end surface of the closing body which is oriented perpendicular to an axis of rotation of the closing lid, and in that the closing lid has a sealing element configured to mate with the end surface.

10. The closing device of claim 9, wherein the end surface is arranged radially outside the guide.

11. The closing device of claim 9, wherein the guide element of the closing body is recessed in the axial direction in relation to the end surface.

12. The closing device of claim 9, wherein the sealing element does not extend around a circumference of the closing lid and is interrupted by a cutout that is axially aligned with the liquid passage when the closing device is in the flow state.

13. The closing device of claim 1, wherein the closing body includes an end surface delimited outwardly by an outer wall surrounding the closing lid, the liquid passage passing through said end surface radially inward of said outer wall.

14. The closing device of claim 1, wherein the closing body includes an end surface perpendicular to an axis of rotation of the closing lid and the liquid passage extends through the end surface radially spaced from the axis of rotation of the closing lid.

15. A closing device for a beverage container, having a closing body and a closing lid, wherein the closing lid is mounted so as to be rotatable in relation to the closing body between a flow state and a sealing state, wherein a liquid passage through the closing body is open in the flow state and is closed in the sealing state, having a guide between the closing lid and the closing body, wherein the guide comprises two preferred positions with which the sealing state and the flow state are defined, wherein the rotatable mounting between the closing lid and the closing body is in the form of a threaded mounting, wherein the thread pitch is dimensioned in such a manner that the guide is disengaged axially by rotation of the closing lid relative to the closing body of not more than 360°, wherein the closing body includes an air passage spaced apart from the liquid passage, a sealing element of the closing lid is spaced apart axially from the air passage and the liquid passage of the closing body in the flow state.

16. A closing device for a beverage container, having a closing body and a closing lid, wherein the closing lid is mounted so as to be rotatable in relation to the closing body between a flow state and a sealing state, wherein a liquid passage through the closing body is open in the flow state and is closed in the sealing state, having a guide between the closing lid and the closing body in the form of a sliding guide with a first guide element on the closing lid and a second guide element on the closing body, wherein the guide comprises two preferred positions with which the sealing state and the flow state are defined, said first guide element sliding along the second guide element on an actuation path between the sealing state and the flow state, wherein the rotatable mounting between the closing lid and the closing body is in the form of a threaded mounting, wherein the thread pitch is dimensioned in such a manner that the guide is disengaged axially by rotation of the closing lid relative to the closing body of not more than 360° wherein the guide device moves along an actuation path between the sealing state and the flow state, wherein the liquid passage is in the flow state when the first guide element of the closing lid is in a first preferred position, and the liquid passage is in the sealing state when the first guide element of the closing lid is slid in a first direction to the second preferred position, and as the first guide element of the closing lid is slid in a second direction past the first position, the closing lid and the closing body are separated.

* * * * *